US007163015B2

(12) United States Patent
Moffitt

(10) Patent No.: US 7,163,015 B2
(45) Date of Patent: Jan. 16, 2007

(54) OPPOSED SEAM ELECTRICALLY HEATED CIGARETTE SMOKING SYSTEM

(75) Inventor: Robert H. Moffitt, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 324 days.

(21) Appl. No.: 10/354,012

(22) Filed: Jan. 30, 2003

(65) Prior Publication Data

US 2004/0149298 A1 Aug. 5, 2004

(51) Int. Cl.
*A24F 1/22* (2006.01)

(52) U.S. Cl. ..... 131/194; 131/365; 131/360; 131/366; 131/339

(58) Field of Classification Search ..... 131/365, 131/360, 366, 194, 331, 339
See application file for complete search history.

(56) References Cited

U.S. PATENT DOCUMENTS 3,526,231 A * 9/1970 Verbakel ..... 131/64.1
5,388,594 A 2/1995 Counts et al.
5,505,214 A 4/1996 Collins et al.
5,591,368 A 1/1997 Fleischhauer et al.
5,662,126 A * 9/1997 Charlton et al. ..... 131/342
5,666,976 A * 9/1997 Adams et al. ..... 131/94
5,709,227 A * 1/1998 Arzonico et al. ..... 131/341
6,026,820 A 2/2000 Baggett, Jr. et al.
6,040,560 A 3/2000 Fleischhauer et al.

* cited by examiner

*Primary Examiner*—Dionne W. Mayes
(74) *Attorney, Agent, or Firm*—Buchanan Ingersoll & Rooney PC

(57) ABSTRACT

An electrically heated cigarette smoking system includes a cigarette that is formed with a tobacco rod portion, a filter tube portion, a tobacco mat layer wrapped around the tobacco rod portion and the filter tube portion with opposite ends of the tobacco mat layer abutting along a seam parallel to the central axis of the cigarette and cigarette paper wrapped around the tobacco mat layer and bonded to itself along an overlapped seam that is offset from the seam of the tobacco mat layer. The method of manufacturing the cigarette includes wrapping the tobacco mat layer and the cigarette paper around the tobacco rod portion and the filter tube portion on a single, high-speed machine.

12 Claims, 5 Drawing Sheets

OPPOSED SEAM ELECTRICALLY HEATED CIGARETTE SMOKING SYSTEM

FIELD OF THE INVENTION

The present invention relates generally to a cigarette and a method of making the cigarette for an electrically heated cigarette smoking system.

BACKGROUND OF THE INVENTION

Traditional cigarettes deliver flavor and aroma to the smoker as a result of combustion, during which a mass of tobacco is combusted at temperatures which often exceed 800° C. during a puff. The heat of combustion releases various gaseous combustion products and distillates from the tobacco. As these gaseous products are drawn through the cigarettes, they cool and condense to form an aerosol which provides the tastes and aromas associated with smoking.

Traditional cigarettes produce sidestream smoke during smoldering between puffs. Once lit, they must be fully consumed or be discarded. Relighting a traditional cigarette is possible but is usually not desirable for subjective reasons including flavor, taste, and odor.

An alternative to the more traditional cigarettes includes those in which a combustible material heats a separate bed of tobacco sufficiently to release an aerosol. Such cigarettes may comprise a combustible, carbonaceous heating element (heat source) located at or about one end of the cigarette in a bed of tobacco-laden elements located adjacent the aforementioned heating element. Commonly assigned U.S. Pat. Nos. 5,388,594 and 5,505,214 disclose various heating elements and cigarettes which significantly reduce sidestream smoke while permitting the smoker to selectively suspend and reinitiate smoking.

The aforementioned, U.S. Pat. No. 5,388,594, which is hereby incorporated in its entirety by reference, describes an electrical smoking system including a novel electrically powered lighter and a novel cigarette that cooperates with the lighter. The preferred embodiment of the lighter includes a plurality of metallic serpentine heaters disposed in a configuration that slidingly receives a tobacco rod portion of the cigarette.

The preferred embodiment of the cigarette in U.S. Pat. No. 5,388,594 comprises a tobacco-laden tubular carrier, a cigarette paper overwrapped about the tubular carrier, an arrangement of flow-through filter plugs at a mouthpiece end of the carrier and a filter plug at the free (distal) end of the carrier. The carrier and the lighter are configured such that when the cigarette is inserted into the lighter and as individual heaters are activated for each puff, localized charring occurs at spots about the cigarette in the locality where each heater was bearing against the cigarette (hereinafter referred to as a "heater footprint"). Once all the heaters have been activated, the charred spots are closely spaced from one another and encircle a central portion of the carrier portion of the cigarette.

It is now realized in practice with an electrically heated cigarette smoking system such as that disclosed in U.S. Pat. No. 5,388,594, that non-uniformity of the cigarette circumferences out-of-roundness and deformation of the cigarette when inserted into the lighter may impact performance of electrically heated cigarette smoking system by preventing desired portions of the cigarette from being placed in consistent contact with the various heater elements. Accordingly, it is an object of the present invention to provide a cigarette of an electrical smoking system which has enhanced uniformity in circumference, enhanced roundness and enhanced resistance to deformation.

SUMMARY OF THE INVENTION

In view of the above-desired characteristics of cigarettes for electrically heated cigarette smoking systems, an embodiment of the present invention provides an electrically heated cigarette for an electrically heated cigarette smoking system that includes a tobacco rod having a tobacco plug portion, a filter tube portion, a tobacco mat layer wrapped around the tobacco plug portion and the filter tube portion, with opposite ends of the tobacco mat layer abutting along a longitudinal seam parallel to the central axis of the cigarette, and cigarette paper wrapped around the tobacco mat layer and bonded to itself along an overlapped longitudinal seam that is circumferentially offset from the abutting seam of the tobacco mat layer. In a preferred embodiment of the invention the overlapped longitudinal seam of the cigarette paper is antipodal to the abutting seam of the tobacco mat layer.

An electrically heated cigarette according to an embodiment of the invention further includes a tipping, which as understood by one of ordinary skill in the art of cigarette making constitutes the filter section of a cigarette. The tipping comprises a free-flow filter located adjacent the filter tube portion of the tobacco rod and a mouthpiece filter located at the distal end of the tipping from the filter tube portion, the free-flow filter and the mouthpiece filter being joined together by a plug wrap, and the tipping being joined to the filter tube portion of the tobacco rod by tipping paper.

The invention also is directed to a method of manufacturing a cigarette for an electrically heated cigarette smoking system, that includes the steps of positioning at least one tobacco plug portion and at least one filter tube portion in a holding fixture of a cigarette making machine, the at least one tobacco plug portion and the at least one filter tube portion being aligned with one another at an axial spacing from each other, moving the aligned and spaced tobacco plug and filter tube portion in a direction perpendicular to their central axes, applying an edge of a tobacco mat layer spanning the at least one tobacco plug portion and the at least one filter tube portion spaced from each other, with the edge of the tobacco mat layer positioned at a first circumferential position on the combination of the at least one tobacco plug portion and the at least one filter tube portion, wrapping the tobacco mat layer part way around the circumference of the combination, applying an edge of a cigarette paper layer on the tobacco mat layer, with the edge of the cigarette paper layer substantially parallel to and spaced from the edge of the tobacco mat layer, and wrapping the tobacco mat layer and the cigarette paper layer around the circumference of this combination.

The tobacco mat layer and the cigarette paper layer are wrapped around the circumference of the combination of at least one tobacco plug portion and at least one filter tube portion until opposite edges of the tobacco mat layer abut against each other and opposite edges of the cigarette paper layer overlap sufficiently to form a bond to itself. The leading edge of the cigarette paper layer is applied to the tobacco mat layer at a position along the circumference of the combination of a tobacco plug portion and a filter tube portion that is approximately diametrically opposed to the edge of the tobacco mat layer.

In an alternative embodiment, the method of manufacturing a cigarette for an electrically heated cigarette smoking system can include the steps of first applying an edge of a cigarette paper layer parallel to and spaced from an edge of a tobacco mat layer, and then applying the edge of the tobacco mat layer to span at least one tobacco plug portion and at least one filter tube portion aligned with each other and spaced from each other, and wrapping the combination of the tobacco mat layer and the cigarette paper layer around the circumference of the combination of the aligned and spaced at least one tobacco plug portion and at least one filter tube portion.

BRIEF DESCRIPTION OF THE DRAWINGS

Advantages and novel features of the present invention will become apparent from the following detailed description of the preferred embodiments when considered in conjunction with the accompanying drawings, wherein.

DETAILED DESCRIPTION OF THE PREFERRED EMBODIMENTS

Figure 5:
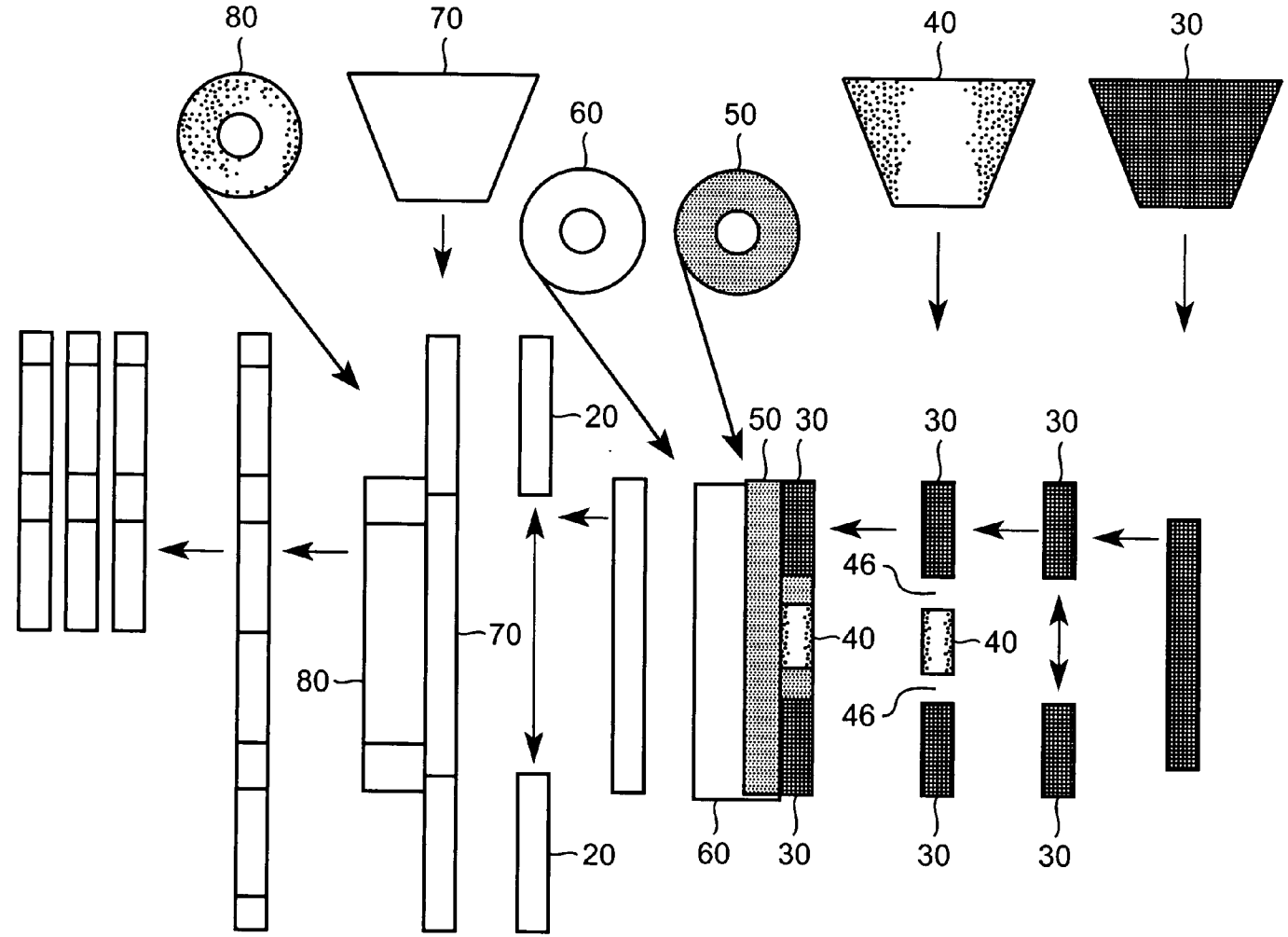
FIG. 5 is a diagram showing the relative movement and placement of cigarette pieces during execution of the preferred method of manufacturing cigarettes according to the invention.

Referring FIGS 1A to 1E, a partially assembled tobacco rod portion of a cigarette for use in an electrically heated cigarette smoking system is shown. Details of both the cigarette and the lighter, are set forth in commonly assigned U.S. Pat. Nos. 5,666,976, 5,388,594, and 5,505,214, which are herein incorporated by reference in their entireties. As shown in FIGS. 1A–1E, a tobacco rod portion 20 of the cigarette for an electrically heated cigarette smoking system includes a tobacco plug 30, a filter tube portion 40 and a void 46 defined in between the tobacco plug and the filter tube. The combination of the tobacco plug and the filter tube are wrapped in a tobacco mat layer 50, and then cigarette paper layer 60. The completely assembled tobacco rod 20 would then be assembled to a filter rod 70 or tipping section of the cigarette using tipping paper 80 as shown in FIG. 5. In a preferred embodiment, the completed cigarette would preferably have an essentially constant diameter along its length, and, like more traditional cigarettes, would preferably be between approximately 7.5 millimeters and 8.5 millimeters in diameter so that the smoking system provides a smoker a familiar sensation when held in the mouth. Additionally, the completed cigarette would preferably be approximately from 60 to 70 millimeters in overall length, thereby facilitating the use of conventional packaging machines in the packaging of the cigarettes. The filter portion of the cigarette would be attached to the tobacco rod 20 with a free-flow filter located adjacent the filter tube 40 and a mouth piece filter plug located at the distal end of the tipping from the tobacco rod 20. As described in more detail in U.S. Pat. No. 5,666,976, which has been incorporated herein by reference, the free-flow filter is tubular and transmits air with very little pressure drop. The mouth piece filter plug closes off the free end of the tipping for purposes of appearance and, if desired, to effect some filtration, although it is preferred that the mouth piece filter plug comprise a lower efficiency filter of preferably about 15–25% efficiency. The free flow filter and the mouth piece filter plug are preferably joined together as a combined plug with a plug wrap, where the plug wrap is preferably a porous, low weight plug wrap as is conventionally available to those in the art of cigarette making. The combined plug is attached to the tobacco rod 20 by the tipping paper of specifications that are standard and conventionally used throughout the cigarette industry. The tipping paper may be either cork, white or any other color as decorative preferences may suggest.

Figure 1A:
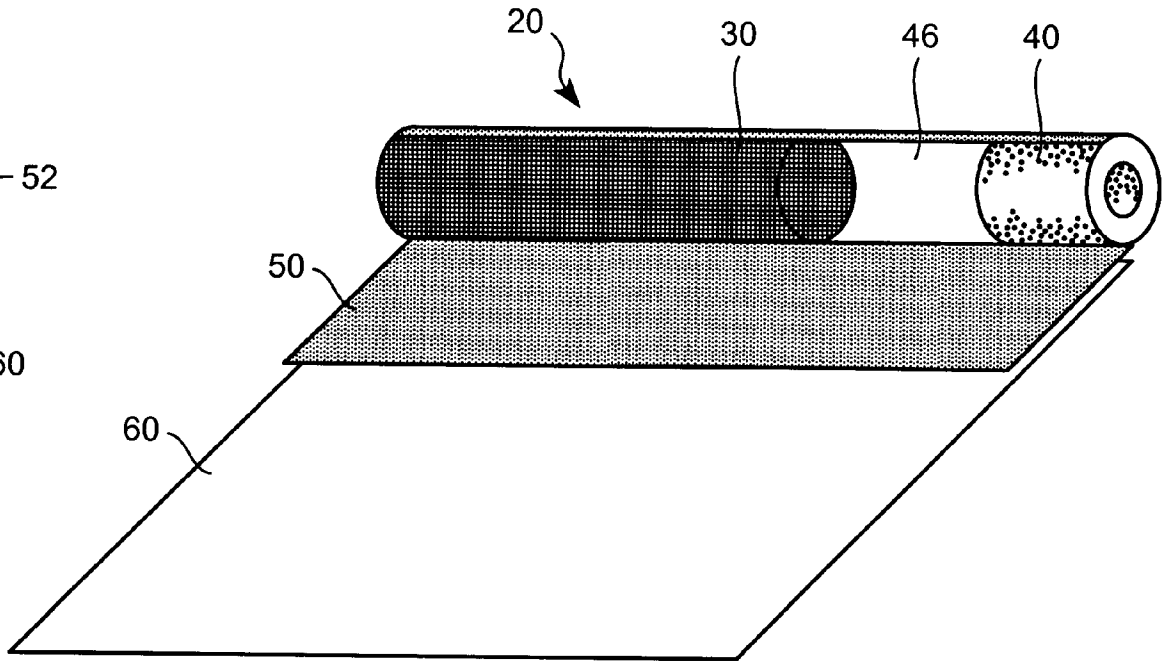
FIG. 1A is a perspective view of a partially assembled tobacco rod according to an embodiment of the invention wherein a tobacco mat layer has been wrapped partially around the circumference of a combination of a tobacco plug and a filter tube that are separated by a space.
Figure 1B:
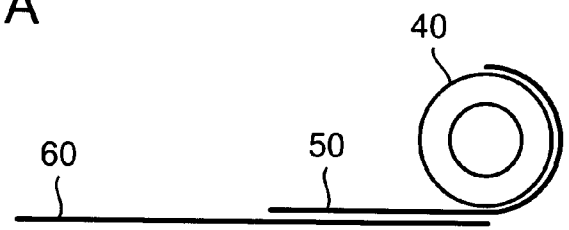
FIG. 1B is a side elevation view of the partially assembled tobacco rod shown in FIG. 1A.
Figure 1C:
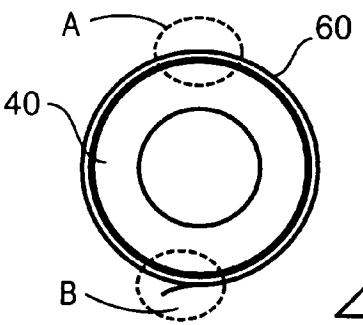
FIG. 1C is a side elevation view of the tobacco rod after the tobacco mat layer and cigarette paper layer have been wrapped completely around the tobacco rod.
Figure 1D:
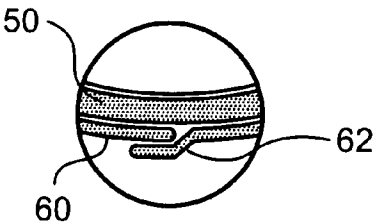
FIG. 1D is a detailed view of the cigarette paper lap seam at portion B in FIG. 1C.
Figure 1E:
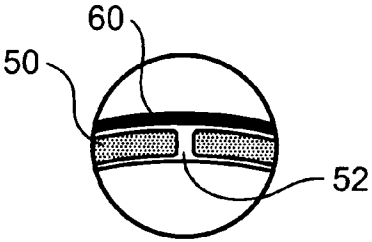
FIG. 1E is a detailed view of the butt seam of the tobacco mat layer at portion A in FIG. 1C.

As shown in FIG. 1A, the tobacco rod 20 of the cigarette preferably includes a tobacco mat layer or web 50 which has been wrapped around the combination of a tobacco plug 30 and a filter tube 40 that are aligned with each other and spaced apart by a void 46. An overwrap of cigarette paper 60 then intimately wraps the tobacco mat layer 50 and is held together along an overlapped longitudinal seam 62, as seen in FIG. 1D. The overwrapped cigarette paper layer 60 retains the tobacco mat layer 50 in a wrapped condition about the tobacco plug 30 and the free-flow filter tube 40.

Preferably, the cigarette paper 60 is wrapped intimately about the tobacco mat layer 50 so as to render the external appearance and feel of a more traditional cigarette. It has been found that a good tasting smoke is achieved when the cigarette paper layer 60 is a standard type of cigarette paper, preferably a flax paper of approximately 20 to 50 CORESTA (defined as the amount of air, measured in cubic centimeters, that passes through one square centimeter of material, e.g., a paper sheet, in one minute at a pressure drop of 1.0 kilopascal) and more preferably of about 30–45 CORESTA, a basis weight of approximately 23–35 grams per meter squared ($g/m^2$) and more preferably about 23–30 $g/m^2$, and a filler loading (preferably calcium carbonate) of approximately 23–35% by weight and more preferably 28–33% by weight. The cigarette paper 60 may contain little or no citrate or other burn modifiers, with preferred levels of citrate ranging from zero to approximately 2.6% by weight of the overwrap cigarette paper 60 and more preferably less than 1%. Alternatively, non-standard cigarette paper can also be used containing ammonium of magnesium phosphate. The basis weight and exact filler loading or other constituent levels can also be varied to achieve desired characteristics including flavor, burn characteristics, resistance to draw, etc.

The tobacco web or mat layer 50 preferably comprises a base web and a layer of tobacco flavor material located along the inside surface of the base web. The tobacco mat layer can have a basis weight of approximately 170–225 g/m$^2$, and can also be unflavored if desired. As shown in FIG. 1A, at the tipped end of the tobacco rod 20, the tobacco mat layer 50 together with the cigarette paper layer 60 are wrapped about the tubular free-flow filter plug 40. The free-flow filter plug 40 provides structural definition and support at the tipped end of the tobacco rod 20 and permits aerosol to be withdrawn from the interior of the tobacco rod with a minimum pressure drop. The free-flow filter tube 40 also acts as a flow constriction at the tipped end of the tobacco rod 20, which is believed to help promote the formation of aerosol during a draw on the cigarette. The free-flow filter tube 40 is preferably at least 7 millimeters long to facilitate machine handling and is preferably annular, although other shapes and types of low efficiency filter are suitable, including cylindrical filter plugs.

The tobacco plug 30 is constructed separately from the tobacco mat layer 50 and comprises a relatively short column of cut filler tobacco that has been wrapped within and retained by a plug wrap. The tobacco plug 30 is generally constructed on a conventional cigarette rod making machine wherein cut filler (preferably blended) is formed into a continuous rod of tobacco on a traveling belt and enwrapped with a continuous ribbon of plug wrap which is then glued along its longitudinal seam and heat sealed.

In conventional cigarette manufacturing operations, the tobacco plugs 30 and filter tubes 40 are delivered to a combining machine such as the Molins double-action plug-tube combiner ("DAPTC"). In a typical Molins DAPTC combiner, the tobacco plugs 30 and filter tubes 40 are axially aligned with each other and fed at a desired spacing into a garniture, with the tobacco plugs and the filter tubes moving in a direction that is parallel to their central axis. The tobacco plugs and filter tubes are moved into contact with ribbons of tobacco mat material and cigarette paper material in the garniture, and the ribbon of tobacco mat material and the cigarette paper is folded about the spaced apart tobacco plugs and tubular filters to produce a continuous rod, which is then cut to produce plugs. The conventional process of forming the tobacco rod by folding the tobacco mat layer and the cigarette paper around the spaced tobacco plug and the filter tube portions while moving the tobacco plugs and filter tubes in a direction parallel to their central axes results in the longitudinal seams of the tobacco mat layer and the cigarette paper layer being substantially aligned with each other.

In contrast to the assembly operation that is performed in a conventional Molins DATPC combiner, the tobacco rod 20 that is produced according to an embodiment of the present invention has a longitudinal seam of the tobacco mat layer that is significantly offset from the longitudinal seam of the cigarette paper layer, with the longitudinal seams of the tobacco mat layer and the cigarette paper layer being preferably antipodal to each other. The tobacco rod according to the invention can be assembled on the same cigarette tipping machine, such as a Hauni Max, that is used to join the tobacco rod to the filter portion of the cigarette. As a result, the method according to the present invention eliminates the need for the current tobacco rod forming operation that is performed on a Molins DAPTC combining machine. Instead, the present invention provides for full component assembly of the cigarette for an electrically heated cigarette smoking system on a higher speed, modified tipping machine such as a DHMax tipper.

The current DAPTC production process assembles the tobacco plug and the filter tube components with a cavity between them and then wraps the assembly with the layer of tobacco mat material and the cigarette paper resulting in the cigarette paper seam lying on top of the tobacco mat seam. Circumference control and proper component registration are difficult to maintain in this process. Furthermore, the aligned seam configuration results in relatively low structural strength of the finished tobacco rod, which is a contributing factor to cigarette break-offs during use in the electrically heated cigarette system lighter.

Figure 6:
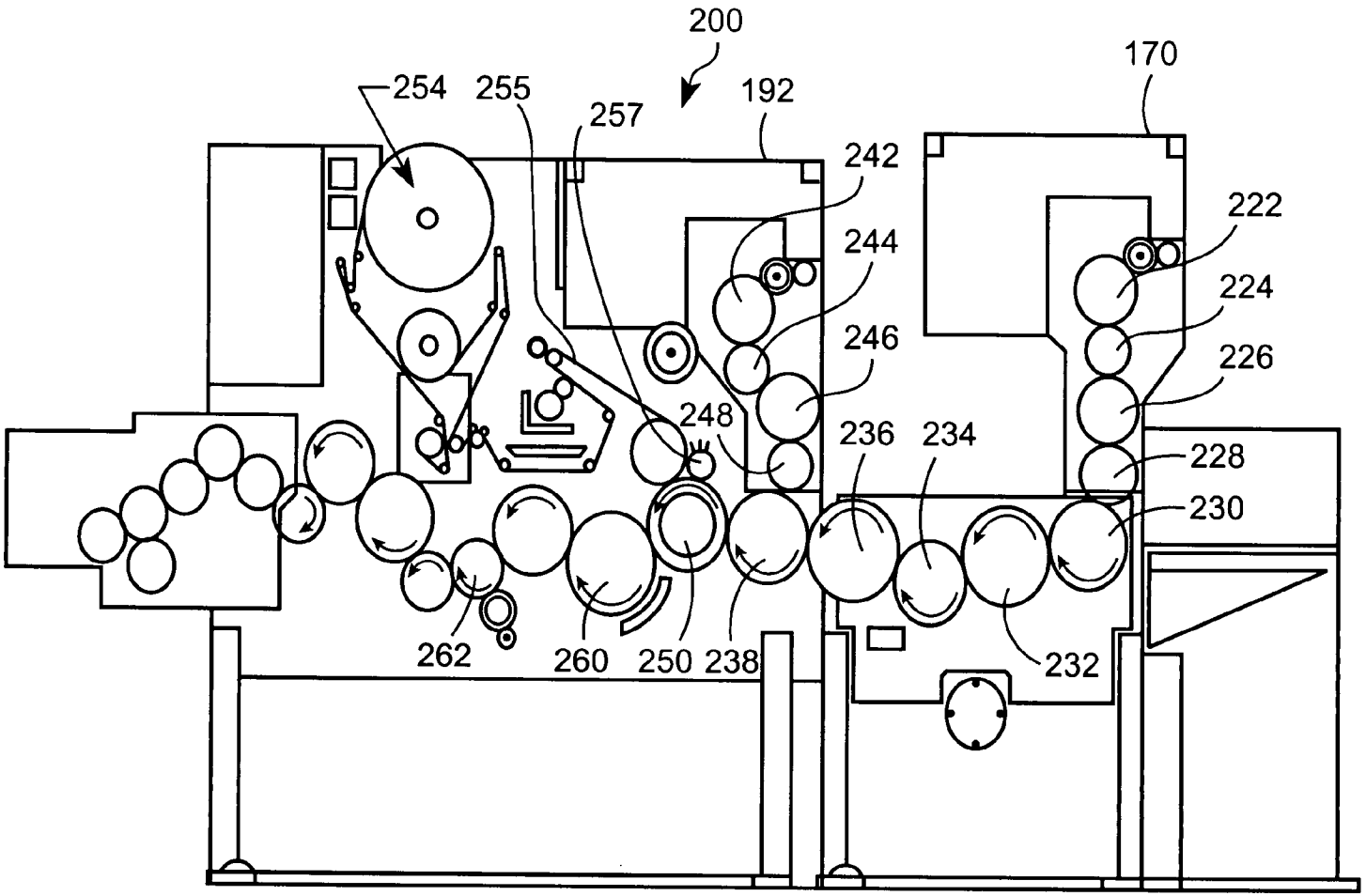
FIG. 6 is a diagram of a tipping apparatus which can be adapted to perform all of the steps of assembling a cigarette for use in an electrically heated cigarette smoking system, in accordance with an embodiment of the invention.

The modified tipping machine, such as a tipping machine shown in FIG. 6, will receive 2-up or 4-up tobacco plugs produced on a conventional cigarette maker either directly from the maker or via a tray feed system. It is to be understood that references to a 2-up or a 4-up tobacco plug refer to a plug construction such that if it were divided into 2 or 4 pieces, would render 2 or 4 complete tobacco plugs of the preferred cigarette.

As shown in FIG. 5, a 2-up tobacco plug 30 is cut and spread apart to allow for insertion or placement of a foil-lined filter tube component 40 with a predetermined space 46 defining a cavity between the tobacco plug 20 and the filter tube 40. The tobacco mat layer 50 and the cigarette paper layer 60 are then wrapped around the tobacco plug/cavity/filter tube components with the tobacco mat layer applied first and wrapped approximately 180° around the circumference of the combined components. The cigarette paper 60 is then introduced onto the tobacco mat layer 50 at approximately the 180° position and wrapped a full 360° with a sufficient width of cigarette paper allowed to produce the overlap seam 62, best seen in FIG. 1D. The mat layer 50 is cut to a narrower width than the cigarette paper, such that when it is wrapped completely around the combination of the tobacco plug/cavity/filter tube, it results in a butt seam 52, best seen in FIG. 1E. As seen in FIG. 1C, this configuration provides for the tobacco mat layer and the cigarette paper seams to be antipodal to each other.

Figure 3:
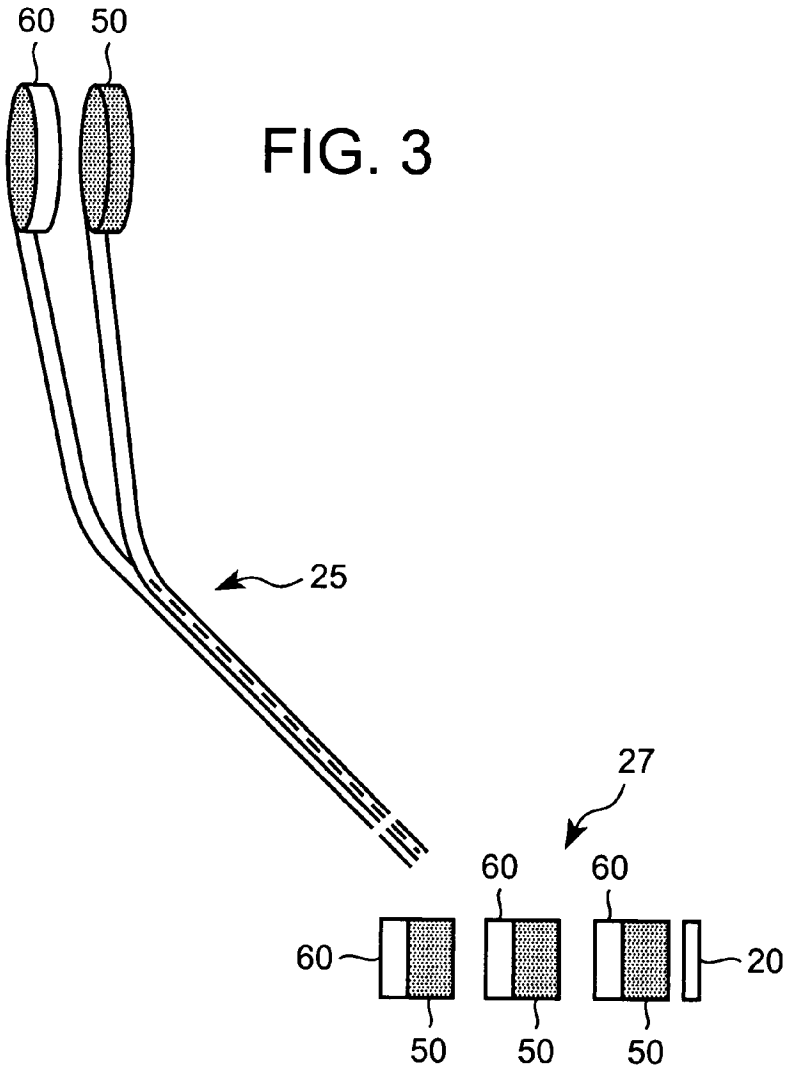
FIG. 3 illustrates a second embodiment of a wrapping step according to an embodiment of the invention, wherein the tobacco mat material and cigarette paper material are provided from rolls of material and are bonded to each other in an offset position before being cut into separate pieces to be wrapped about a tobacco rod.
Figure 2:
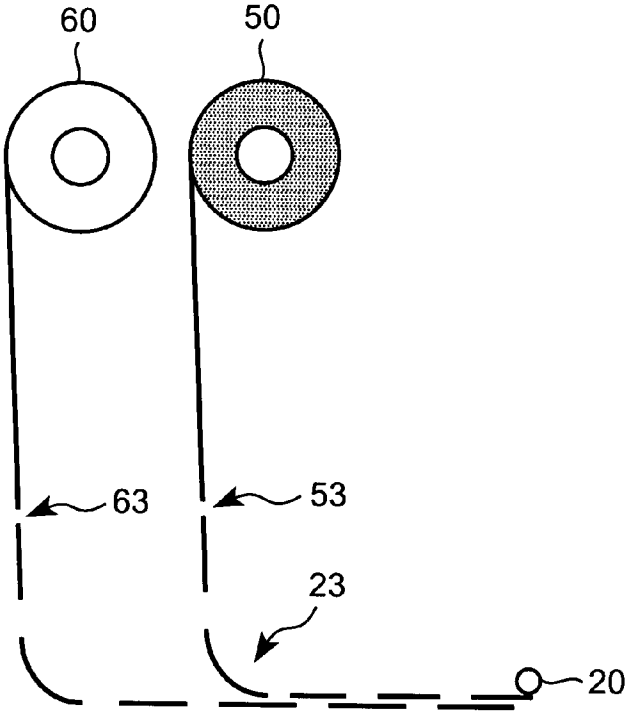
FIG. 2 illustrates a first embodiment of a wrapping step according to an embodiment of the invention, wherein tobacco mat material and cigarette paper are supplied from rolls of material, the tobacco mat layer is applied along an edge to a tobacco rod, and the cigarette paper layer is applied to the tobacco mat layer along an edge that is parallel to and offset from the edge of the tobacco mat layer.
Figure 4:
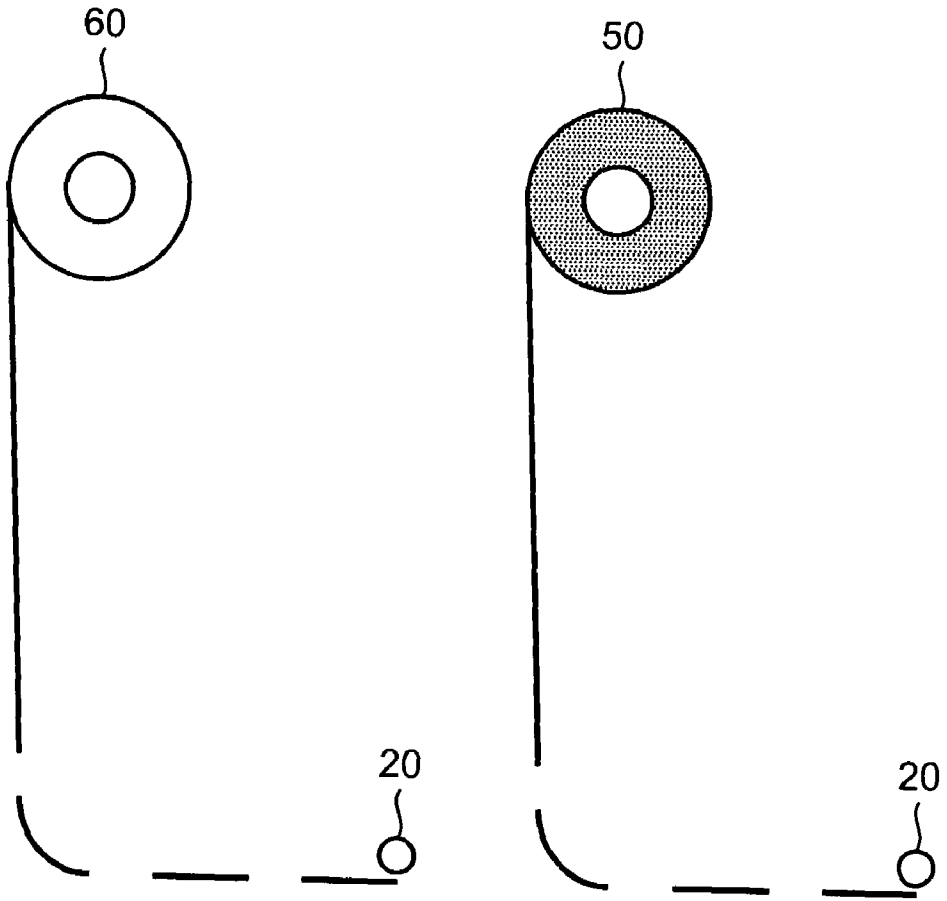
FIG. 4 illustrates a third embodiment of a wrapping step according to an embodiment of the invention, wherein the tobacco mat material is supplied from a roll and first wrapped completely around a tobacco rod, followed by the wrapping of cigarette paper supplied from a separate roll around the tobacco rod wrapped in tobacco mat layer.

As shown in FIGS. 2, 3 and 4, the wrapping of the tobacco mat layer 50 and the cigarette paper layer 60 around the combination of a tobacco plug/cavity/filter tube can be performed in a number of different ways. The tobacco mat layer and the cigarette paper can be provided from bobbins, such as bobbin 254 shown in FIG. 6, and attached to the axially aligned and spaced components of a tobacco plug and a filter tube that are positioned in a flute on a swash-plate drum 250 to initiate connection of the tobacco plug/cavity/filter tube to form a tobacco rod. The wrapping or tipping operation is then continued on a rolled drum 260 which rolls the combined tobacco mat layer 50 and cigarette paper layer 60 about the combination of a tobacco plug/cavity/filter tube.

In accordance with the embodiment of a wrapping operation as shown in FIG. 2, the tobacco mat layer 50 is provided from a bobbin, cut into lengths at 53, and applied along an edge to the circumference of the combination of a tobacco plug/cavity/filter tube. The cigarette paper 60 is also provided from a bobbin, cut into lengths at 63, and is applied and laminated with an adhesive at 23 to the lengths of tobacco mat layer 50 and laminated with an adhesive along an edge that is parallel to the edge of the tobacco mat layer and offset from the edge of the tobacco mat layer such that when the wrapping is completed, the longitudinal seam of the tobacco mat layer will be offset from the longitudinal seam of the cigarette paper layer.

In another alternative wrapping operation, as seen in FIG. 3, the tobacco mat material 50 can be joined and laminated at 25 to the cigarette paper 60 with an adhesive, dried, and positioned, with the edge of the cigarette paper being parallel to and offset from the edge of the tobacco mat layer, before the combination of the tobacco mat layer and cigarette paper layer is severed into sections at 27 that are then wrapped about the circumference of a combination of a tobacco plug/cavity/filter tube 20.

In a third variation to the wrapping operation, as best seen in FIG. 4, the tobacco mat layer 50 could be wrapped completely around the combination of a tobacco plug/cavity/filter tube 20 before the application of the cigarette paper layer 60, with the edge of the cigarette paper layer 60 again being offset from the edge of the tobacco mat layer 50. In all of the wrapping operations shown in FIGS. 2, 3 and 4, the tobacco mat layer 50 and the cigarette paper layer 60 are wrapped about the combination of the tobacco plug/cavity/filter tube 20 as the combination is moved in a direction perpendicular to its central axis. Accordingly, the assembling operation according to the invention can be performed on the same tipping machine, such as that shown in FIG. 6, that is used for combining the filter sections or tipping of the cigarette to the tobacco rod sections.

It is to be understood that the present invention may be embodied in other specific forms and processes without departing from the spirit or essential characteristics of the present invention. Although the disclosure specifies certain machines as being preferred, one of ordinary skill in the art, once familiar with these teachings, would be able to select other machines for executing the disclosed processes. The scope of the invention is indicated by the appended claims rather than by the foregoing descriptions and all changes in variations which fall within the meaning and range of the claims are intended to be embraced therein.

The invention claimed is:

1. An electrically heated cigarette for an electrically heated cigarette smoking system, comprising:

a tobacco plug portion;

a filter tube portion; a tobacco mat layer wrapped around said tobacco plug portion and said filter tube portion, with opposite ends of said tobacco mat layer abutting along a seam parallel to the central axis of the cigarette; and cigarette paper wrapped around said tobacco mat layer and bonded to itself along an overlapped seam that is circumferentially offset from the seam of the tobacco mat layer, and wherein the overlapped seam of the cigarette paper is antipodal to the abutting seam of the tobacco mat layer.

2. The electrically heated cigarette of claim 1, wherein said tobacco plug portion is spaced from said filter tube portion to form a cavity portion in the cigarette.

3. The electrically heated cigarette of claim 1, wherein said filter tube portion comprises a hollow cellulose acetate tube and a metal foil lining.

4. The electrically heated cigarette of claim 1, further including a tipping comprising a free-flow filter located adjacent said filter tube portion and a mouthpiece filter located at the distal end of the tipping from the filter tube portion, said free-flow filter and said mouthpiece filter being joined together by a plug wrap, and the tipping being joined to the filter tube portion by tipping paper.

5. An electrically heated cigarette for an electrically heated cigarette smoking system, comprising:

a tobacco plug portion;

a filter tube portion; a tobacco mat layer wrapped around said tobacco plug portion and said filter tube portion, with opposite ends of said tobacco mat layer abutting one another; and cigarette paper wrapped around said tobacco mat layer and bonded to itself along an overlapped seam with a single layer of said cigarette paper overlying said abutment of the opposite ends of said tobacco mat layer, and wherein the overlapped seam of the cigarette paper is antipodal to said abutment of the opposite ends of said tobacco mat layer.

6. The electrically heated cigarette of claim 5, wherein said tobacco plug portion is spaced from said filter tube portion to form a cavity portion in the cigarette.

7. The electrically heated cigarette of claim 5, wherein said filter tube portion comprises a hollow cellulose acetate tube and a metal foil lining.

8. The electrically heated cigarette of claim 5, further including a tipping comprising a free-flow filter located adjacent said filter tube portion and a mouthpiece filter located at the distal end of the tipping from the filter tube portion, said free-flow filter and said mouthpiece filter being joined together by a plug wrap, and the tipping being joined to the filter tube portion by tipping paper.

9. An electrically heated cigarette for an electrically heated cigarette smoking system, comprising:

a tobacco plug portion;

a filter tube portion; a tobacco mat layer wrapped around said tobacco plug portion and said filter tube portion, with opposite ends of said tobacco mat layer abutting one another; and cigarette paper wrapped around said tobacco mat layer and bonded to itself along an overlapped seam that is circumferentially offset from the abutment of the opposite ends of said tobacco mat layer, and wherein the overlapped seam of the cigarette paper is antipodal to the abutment of the opposite ends of said tobacco mat layer.

10. The electrically heated cigarette of claim 9, wherein said tobacco plug portion is spaced from said filter tube portion to form a cavity portion in the cigarette.

11. The electrically heated cigarette of claim 9, wherein said filter tube portion comprises a hollow cellulose acetate tube and a metal foil lining.

12. The electrically heated cigarette of claim 9, further including a tipping comprising a free-flow filter located adjacent said filter tube portion and a mouthpiece filter located at the distal end of the tipping from the filter tube portion, said free-flow filter and said mouthpiece filter being joined together by a plug wrap, and the tipping being joined to the filter tube portion by tipping paper.

* * * * *